US009214124B1

(12) United States Patent
Yu et al.

(10) Patent No.: US 9,214,124 B1
(45) Date of Patent: Dec. 15, 2015

(54) ROW DRIVING CIRCUIT FOR ARRAY SUBSTRATE AND LIQUID CRYSTAL DISPLAY DEVICE

(71) Applicant: Shenzhen China Star Optoelectronics Technology Co., Ltd., Guangdong (CN)

(72) Inventors: Xiaojiang Yu, Guangdong (CN); Chang Yeh Lee, Guangdong (CN); Tzu-Chieh Lai, Guangdong (CN)

(73) Assignee: Shenzhen China Star Optoelectronics Technology Co., Ltd., Guangdong (CN)

( * ) Notice: Subject to any disclaimer, the term of this patent is extended or adjusted under 35 U.S.C. 154(b) by 0 days.

(21) Appl. No.: 14/386,820

(22) PCT Filed: Jun. 16, 2014

(86) PCT No.: PCT/CN2014/079928
§ 371 (c)(1),
(2) Date: Sep. 22, 2014

(30) Foreign Application Priority Data

May 26, 2014 (CN) ..... 2014 1 0226117

(51) Int. Cl.
*G09G 3/36* (2006.01)

(52) U.S. Cl.
CPC ..... *G09G 3/3648* (2013.01); *G09G 3/3677* (2013.01); *G09G 3/3696* (2013.01); *G09G 2300/0404* (2013.01); *G09G 2300/0426* (2013.01); *G09G 2300/0478* (2013.01)

(58) Field of Classification Search
CPC ..... G11C 27/04; G11C 19/00; G09G 3/3677; G09G 2310/0286; G09G 2300/0408; G09G 2310/0267; G09G 2300/0426; G09G 2310/0283; G09G 3/3674; G09G 3/3688; G09G 3/3266; G09G 3/36
USPC ..... 345/87–103, 204; 377/64–81
See application file for complete search history.

(56) References Cited

U.S. PATENT DOCUMENTS

| | | | | |
|---|---|---|---|---|
| 2007/0171115 | A1* | 7/2007 | Kim et al. | 341/155 |
| 2009/0304138 | A1* | 12/2009 | Tsai et al. | 377/79 |
| 2011/0234577 | A1* | 9/2011 | Yang et al. | 345/212 |
| 2014/0103983 | A1* | 4/2014 | Chang et al. | 327/198 |
| 2014/0118237 | A1* | 5/2014 | Wang | 345/100 |
| 2014/0176410 | A1* | 6/2014 | Ma et al. | 345/92 |

* cited by examiner

*Primary Examiner* — Hong Zhou

(57) ABSTRACT

An n-th stage array substrate row driving unit of a row driving circuit for an array substrate is provided. The n-th stage array substrate row driving unit comprises an (n−3)-th and an (n−2)-th stage signal input terminal and a pull-up controlling unit. The pull-up controlling unit is a first thin film transistor and is connected to the (n−2)-th and a (n−3)-th stage signal input terminal. A peak voltage of the (n−3)-th stage signal input terminal is twice a peak voltage of the (n−2)-th stage signal input terminal. Thus, the threshold voltage shift of the TFT elements can be avoided, and the stability of the output can be improved.

16 Claims, 4 Drawing Sheets

ROW DRIVING CIRCUIT FOR ARRAY SUBSTRATE AND LIQUID CRYSTAL DISPLAY DEVICE

RELATED APPLICATIONS

This application is a National Phase of PCT Patent Application No. PCT/CN2014/079928 having International filing date of Jun. 16, 2014, which claims the benefit of priority of Chinese Patent Application No. 201410226117.1 filed on May 26, 2014. The contents of the above applications are all incorporated by reference as if fully set forth herein in their entirety.

FIELD OF THE INVENTION

The present invention relates to the technical field of a display panel, and more particularly to a row driving circuit for an array substrate and a liquid crystal display device.

BACKGROUND OF THE INVENTION

In traditional display panels, a narrow bezel technology is generally utilized.

In general, adopt Multilayer Metal Traces or Gate electrode driver On Array (GOA) technology is applied in traditional narrow bezels. However, multilayer metal traces are not suited for applying to a narrow bezel and will probably result in a short circuit in a panel, so that the yield declines and the costs of the components rise. GOA can be suited for applying to a narrow bezel and the cost of the Gate electrode IC can be reduced.

In practice, most of the GOA circuits have some limitations. For example, TFT (Thin Film Transistor) elements of the GOA circuit produce a threshold voltage shift for stress resistance, thus affecting the stability of the output of the GOA circuit.

Therefore, it is necessary to provide another technical solution in order to solve the problems with the threshold voltage shift of the TFT elements and the stability of the output in the GOA circuit of the prior art.

SUMMARY OF THE INVENTION

An object of the present invention is to provide a row driving circuit for an array substrate and a liquid crystal display device, which can avoid the threshold voltage shift of the TFT elements, so as to improve the stability of the output of the GOA circuit.

To achieve the above object, the present invention provides a technical solution as follows:

A row driving circuit for an array substrate, comprising array substrate row driving units with multi-stage connections, wherein an n-th stage array substrate row driving unit in the row driving circuit for the array substrate comprises:

an (n−3)-th stage signal input terminal, an (n−2)-th stage signal input terminal, an (n+2)-th stage signal input terminal, a first output terminal, a second output terminal, a low level input terminal, and a high frequency clock signal input terminal, wherein n is a positive integer greater than 3;

wherein the (n−3)-th stage signal input terminal is connected to the second output terminal of an (n−3)-th stage array substrate row driving unit, and the (n−2)-th stage signal input terminal is connected to the first output terminal of an (n−2)-th stage array substrate row driving unit, and the (n+2)-th signal input terminal is connected to the first output terminal of an (n+2)-th stage array substrate row driving unit, and the second output terminal is connected to an (n−3)-th stage signal input terminal of an (n+3)-th stage array substrate row driving unit, and the first output terminal is connected to an (n−2)-th stage signal input terminal of an (n+2)-th stage array substrate row driving unit and an (n+2)-th stage signal input terminal of an (n−2) stage array substrate row driving unit for providing a scanning signal to an n-th stage horizontal scanning line of a display area;

wherein the n-th stage array substrate row driving unit further comprises:

a pull-up controlling unit including a first thin film transistor, wherein the first thin film transistor comprises a first gate electrode, a first source electrode, and a first drain electrode, and the first gate electrode is connected to the (n−3)-th stage signal input terminal, the first source electrode is connected to the (n−2)-th stage signal input terminal, the first drain electrode is connected to a pull-down controlling unit, and the first drain electrode, a pull-down unit, and a pull-up unit are connected to the second output terminal, and a peak voltage of the (n−3)-th stage signal input terminal is twice a peak voltage of the (n−2)-th stage signal input terminal for pulling up an electric potential of the second output terminal;

wherein the pull-up unit includes a capacitor and a second thin film transistor, and the second thin film transistor comprises a second gate electrode, a second source electrode, and a second drain electrode, and the capacitor comprises a first electrode plate and a second electrode plate, and the second gate electrode is connected to the pull-up controlling unit and the first electrode plate of the capacitor through the second output terminal, the second source electrode is connected to the high frequency clock signal input terminal, and the second drain electrode is connected to the first output terminal for charging a signal of the first output terminal, so that the second output terminal has a higher electric potential;

wherein the low level input terminal, the pull-up controlling unit, and the pull-up unit are connected to the pull-down controlling unit for keeping a low electric potential of the second output terminal and the first output terminal when the signal of the first output terminal is non-chargeable;

wherein the (n+2)-th stage signal input terminal, the low level input terminal, and the pull-down controlling unit are connected to the pull-down unit, and the pull-down unit, the pull-up unit, and the pull-up controlling unit are connected to the second output terminal for pulling down an electric potential of the second output terminal.

In one embodiment of the row driving circuit for the array substrate, the pull-down controlling unit comprises a first pull-down controlling sub-unit;

wherein the first pull-down controlling sub-unit comprises a third thin film transistor;

wherein the third thin film transistor comprises a third gate electrode, a third source electrode, and a third drain electrode; the third gate electrode is connected to the first drain electrode, and the third drain is connected to the low level input terminal;

wherein the first pull-down controlling sub-unit further comprises a fourth thin film transistor and a fifth thin film transistor; the fourth thin film transistor comprises a fourth gate electrode, a fourth source electrode, and a fourth drain electrode; the fifth thin film transistor comprises a fifth gate electrode, a fifth source electrode, and a fifth drain electrode;

wherein the fourth gate electrode and the fifth gate electrode are connected to the third source electrode, the fourth source electrode and the fifth source electrode are connected to the second electrode plate of the capacitor and the first output terminal, the fourth drain electrode is connected to the low level input terminal, and the fifth drain is connected to the third gate electrode.

In one embodiment of the row driving circuit for the array substrate, the n-th stage array substrate row driving unit further comprises a low frequency clock signal first input terminal and a low frequency clock signal second input terminal;

wherein the first pull-down controlling sub-unit further comprises a sixth thin film transistor and a seventh thin film transistor; the sixth thin film transistor comprises a sixth gate electrode, a sixth source electrode, and a sixth drain electrode; the seventh thin film transistor comprises a seventh gate electrode, a seventh source electrode, and a seventh drain electrode;

wherein the sixth gate electrode, the six source electrode, and the seventh source electrode are connected to the low frequency clock signal first input terminal, the seventh gate electrode is connected to the low frequency clock signal second input terminal, and the sixth drain electrode and the seventh drain are connected to the fourth gate electrode.

In one embodiment of the row driving circuit for the array substrate, the n-th stage array substrate row driving unit further comprises a second pull-down controlling sub-unit;

wherein the second pull-down controlling sub-unit comprises an eighth thin film transistor, and the eighth thin film transistor comprises an eighth gate electrode, an eighth source electrode, and an eighth drain electrode;

wherein the eighth gate electrode is connected to the first drain electrode, and the eighth drain electrode is connected to the low level input terminal;

wherein the second pull-down controlling sub-unit further comprises a ninth thin film transistor and a tenth thin film transistor; the ninth thin film transistor comprises a ninth gate electrode, a ninth source electrode, and a ninth drain electrode; the tenth thin film transistor comprises a tenth gate electrode, a tenth source electrode, and a tenth drain electrode;

wherein the ninth gate electrode and the tenth gate electrode are connected to the eighth source electrode, the ninth source electrode and the tenth source electrode are connected to the fourth source electrode, the fifth source electrode, the second electrode plate of the capacitor, and the first output terminal, the ninth drain electrode is connected to the low level input terminal, and the tenth drain electrode is connected to the eighth gate electrode.

In one embodiment of the row driving circuit for the array substrate, the second pull-down controlling sub-unit further comprises an eleventh thin film transistor and a twelfth thin film transistor; the eleventh thin film transistor comprises an eleventh gate electrode, an eleventh source electrode, and an eleventh drain electrode; the twelfth thin film transistor comprises a twelfth gate electrode, a twelfth source electrode, and a twelfth drain electrode;

wherein the eleventh gate electrode, the eleventh source electrode, and the twelfth source electrode are connected to the low frequency clock signal second input terminal, the twelfth gate electrode is connected to the low frequency clock signal first input terminal, and the eleventh drain electrode and the twelfth drain electrode are connected to the ninth gate electrode.

In one embodiment of the row driving circuit for the array substrate, the pull-down unit is a thirteenth thin film transistor, and the thirteenth thin film transistor comprises a thirteenth gate electrode, a thirteenth source electrode, and a thirteenth drain electrode;

wherein the thirteenth gate electrode is connected to the (n+2)-th stage signal input terminal, the thirteenth drain electrode is connected to the low level input terminal, and the thirteenth source electrode is connected to the second gate electrode.

A row driving circuit for an array substrate comprises array substrate row driving units with multi-stage connections, wherein an n-th stage array substrate row driving unit in the row driving circuit for the array substrate comprises an (n−3)-th stage signal input terminal, an (n−2)-th stage signal input terminal, an (n+2)-th stage signal input terminal, a first output terminal, a second output terminal, a low level input terminal, and a high frequency clock signal input terminal, wherein n is a positive integer greater than 3;

wherein the (n−3)-th stage signal input terminal is connected to the second output terminal of an (n−3)-th stage array substrate row driving unit, the (n−2)-th stage signal input terminal is connected to the first output terminal of an (n−2)-th stage array substrate row driving unit, the (n+2)-th signal input terminal is connected to the first output terminal of an (n+2) stage array substrate row driving unit, the second output terminal is connected to an (n−3)-th stage signal input terminal of a (n+3)-th stage array substrate row driving unit, and the first output terminal is connected to an (n−2)-th stage signal input terminal of an (n+2)-th stage array substrate row driving unit and an (n+2)-th stage signal input terminal of an (n−2)-th stage array substrate row driving unit for providing a scanning signal to an n-th stage horizontal scanning line of a display area;

wherein the n-th stage array substrate row driving unit further comprises:

a pull-up controlling unit including a first thin film transistor, wherein the first thin film transistor is connected to the (n−3)-th stage signal input terminal, the (n−2)-th stage signal input terminal, and the second output terminal, and a peak voltage of the (n−3)-th stage signal input terminal is twice a peak voltage of the (n−2)-th stage signal input terminal for pulling up an electric potential of the second output terminal;

wherein a pull-up unit is connected to the high frequency clock signal input terminal and the first output terminal; the pull-up controlling unit and the pull-up unit are connected to the second output terminal for charging a signal of the first output terminal, and thus the second output terminal has a higher electric potential;

wherein the low level input terminal, the pull-up controlling unit, and the pull-up unit are connected to a pull-down controlling unit for keeping a low electric potential of the second output terminal and the first output terminal when the signal of the first output terminal is non-chargeable;

wherein the (n+2)-th stage signal input terminal, the low level input terminal, and the pull-down controlling unit are connected to a pull-down unit; the pull-down unit, the pull-up unit, and the pull-up controlling unit are connected to the second output terminal for pulling down an electric potential of the second output terminal.

In one embodiment of the row driving circuit for the array substrate, the first thin film transistor comprises a first gate electrode, a first source electrode, and a first drain electrode;

wherein the first gate electrode is connected to the (n−3)-th stage signal input terminal, the first source electrode is connected to the (n−2)-th stage signal input terminal, the first drain electrode is connected to the pull-down controlling unit, and the first drain electrode, the pull-down unit, and the pull-up unit are connected to the second output terminal.

In one embodiment of the row driving circuit for the array substrate, the pull-up unit includes a capacitor and a second thin film transistor; the second thin film transistor comprises a second gate electrode, a second source electrode, and a second drain electrode; the capacitor comprises a first electrode plate and a second electrode plate;

wherein the second gate electrode is connected to the pull-up controlling unit and the first electrode plate of the capacitor through the second output terminal, the second source electrode is connected to the high frequency clock signal input terminal, and the second drain electrode is connected to the first output terminal.

In one embodiment of the row driving circuit for the array substrate, the pull-down controlling unit comprises a first pull-down controlling sub-unit;

wherein the first pull-down controlling sub-unit comprises a third thin film transistor, and the third thin film transistor comprises a third gate electrode, a third source electrode, and a third drain electrode;

wherein the third gate electrode is connected to the first drain electrode, and the third drain is connected to the low level input terminal;

wherein the first pull-down controlling sub-unit further comprises a fourth thin film transistor and a fifth thin film transistor; the fourth thin film transistor comprises a fourth gate electrode, a fourth source electrode, and a fourth drain electrode; the fifth thin film transistor comprises a fifth gate electrode, a fifth source electrode, and a fifth drain electrode;

wherein the fourth gate electrode and the fifth gate electrode are connected to the third source electrode, the fourth source electrode and the fifth source electrode are connected to the second electrode plate of the capacitor and the first output terminal, the fourth drain electrode is connected to the low level input terminal, and the fifth drain is connected to the third gate electrode.

In one embodiment of the row driving circuit for the array substrate, the n-th stage array substrate row driving unit further comprises a low frequency clock signal first input terminal and a low frequency clock signal second input terminal;

wherein the first pull-down controlling sub-unit further comprises a sixth thin film transistor and a seventh thin film transistor; the sixth thin film transistor comprises a sixth gate electrode, a sixth source electrode, and a sixth drain electrode; the seventh thin film transistor comprises a seventh gate electrode, a seventh source electrode, and a seventh drain electrode;

wherein the sixth gate electrode, the six source electrode, and the seventh source electrode are connected to the low frequency clock signal first input terminal, the seventh gate electrode is connected to the low frequency clock signal second input terminal, and the sixth drain electrode and the seventh drain are connected to the fourth gate electrode.

In one embodiment of the row driving circuit for the array substrate, the n-th stage array substrate row driving unit further comprises a second pull-down controlling sub-unit;

wherein the second pull-down controlling sub-unit comprises an eighth thin film transistor, and the eighth thin film transistor comprises an eighth gate electrode, an eighth source electrode, and an eighth drain electrode;

wherein the eighth gate electrode is connected to the first drain electrode, and the eighth drain electrode is connected to the low level input terminal;

wherein the second pull-down controlling sub-unit further comprises a ninth thin film transistor and a tenth thin film transistor; the ninth thin film transistor comprises a ninth gate electrode, a ninth source electrode, and a ninth drain electrode; the tenth thin film transistor comprises a tenth gate electrode, a tenth source electrode, and a tenth drain electrode;

wherein the ninth gate electrode and the tenth gate electrode are connected to the eighth source electrode, the ninth source electrode and the tenth source electrode are connected to the fourth source electrode, the fifth source electrode, the second electrode plate of the capacitor, and the first output terminal, the ninth drain electrode is connected to the low level input terminal, and the tenth drain electrode is connected to the eighth gate electrode.

In one embodiment of the row driving circuit for the array substrate, the second pull-down controlling sub-unit further comprises an eleventh thin film transistor and twelfth thin film transistor; the eleventh thin film transistor comprises an eleventh gate electrode, an eleventh source electrode, and an eleventh drain electrode; the twelfth thin film transistor comprises a twelfth gate electrode, a twelfth source electrode, and a twelfth drain electrode;

wherein the eleventh gate electrode, the eleventh source electrode, and the twelfth source electrode are connected to the low frequency clock signal second input terminal, the twelfth gate electrode is connected to the low frequency clock signal first input terminal, and the eleventh drain electrode and the twelfth drain electrode are connected to the ninth gate electrode.

In one embodiment of the row driving circuit for the array substrate, the pull-down unit is a thirteenth thin film transistor, and the thirteenth thin film transistor comprises a thirteenth gate electrode, a thirteenth source electrode, and a thirteenth drain electrode;

wherein the thirteenth gate electrode is connected to the (n+2)-th stage signal input terminal, the thirteenth drain electrode is connected to the low level input terminal, and the thirteenth source electrode is connected to the second gate electrode.

A liquid crystal display device comprising an row driving circuit for the array substrate and a display area connected to the array substrate row driving circuit; wherein the array substrate row driving circuit comprises array substrate row driving units with multi-stage connections;

wherein an n-th stage array substrate row driving unit in the row driving circuit for the array substrate comprises an (n−3)-th stage signal input terminal, an (n−2)-th stage signal input terminal, an (n+2)-th stage signal input terminal, a first output terminal, a second output terminal, a low level input terminal, and a high frequency clock signal input terminal, wherein n is a positive integer greater than 3;

wherein the (n−3)-th stage signal input terminal is connected to the second output terminal of an (n−3)-th stage array substrate row driving unit, the (n−2)-th stage signal input terminal is connected to the first output terminal of an (n−2)-th stage array substrate row driving unit, the (n+2)-th signal input terminal is connected to the first output terminal of an (n+2)-th stage array substrate row driving unit, the second output terminal is connected to an (n−3)-th stage signal input terminal of an (n+3)-th stage array substrate row driving unit, and the first output terminal is connected to an (n−2)-th stage signal input terminal of an (n+2)-th stage array substrate row driving unit and an (n+2)-th stage signal input terminal of an (n−2)-th stage array substrate row driving unit for providing a scanning signal to an n-th stage horizontal scanning line of a display area;

wherein the n-th stage array substrate row driving unit further comprises:

a pull-up controlling unit including a first thin film transistor, wherein the first thin film transistor is connected to the (n−3)-th stage signal input terminal, the (n−2)-th stage signal input terminal, and the second output terminal, and a peak voltage of the (n−3)-th stage signal input terminal is twice a peak voltage of the (n−2)-th stage signal input terminal for pulling up an electric potential of the second output terminal;

wherein a pull-up unit is connected to the high frequency clock signal input terminal and the first output terminal; the pull-up controlling unit and the pull-up unit are connected to the second output terminal for charging a signal of the first output terminal, and thus the second output terminal has a higher electric potential;

wherein the low level input terminal, the pull-up controlling unit, and the pull-up unit are connected to a pull-down controlling unit for keeping a low electric potential of the second output terminal and the first output terminal when the signal of the first output terminal is non-chargeable;

wherein the (n+2)-th stage signal input terminal, the low level input terminal, and the pull-down controlling unit are connected to a pull-down unit, and the pull-down unit, the pull-up unit, and the pull-up controlling unit are connected to the second output terminal for pulling down the electric potential of the second output terminal.

In one embodiment of the liquid crystal display device, the display area comprises horizontal scanning lines, two ends of each scanning line are connected the array substrate row driving units respectively, and the horizontal scanning lines are connected to the first output terminal of the array substrate row driving units.

Unlike the prior art, the first thin film transistor of the GOA circuit of the present invention is controlled by the signal of a previous stage, and the signal delivered between the previous stage and the next stage of the GOA circuit is less affected by the threshold voltage shift of the TFT elements than it is in the traditional GOA circuit. Thus, the output of the GOA circuit can avoid being affected by the threshold voltage shift of the TFT elements and the stability of the output can be improved.

DETAILED DESCRIPTION OF THE PREFERRED EMBODIMENTS

The structure and the technical means adopted by the present invention to achieve the above and other objects can best be understood by referring to the following detailed description of the preferred embodiments and the accompanying drawings. Furthermore, the directional terms described by the present invention, such as upper, lower, front, back, left, right, inner, outer, side, longitudinal/vertical, transverse/horizontal, and etc., are only directions by referring to the accompanying drawings, and thus the used directional terms are used to describe and understand the present invention, but the present invention is not limited thereto.

Figure 1:
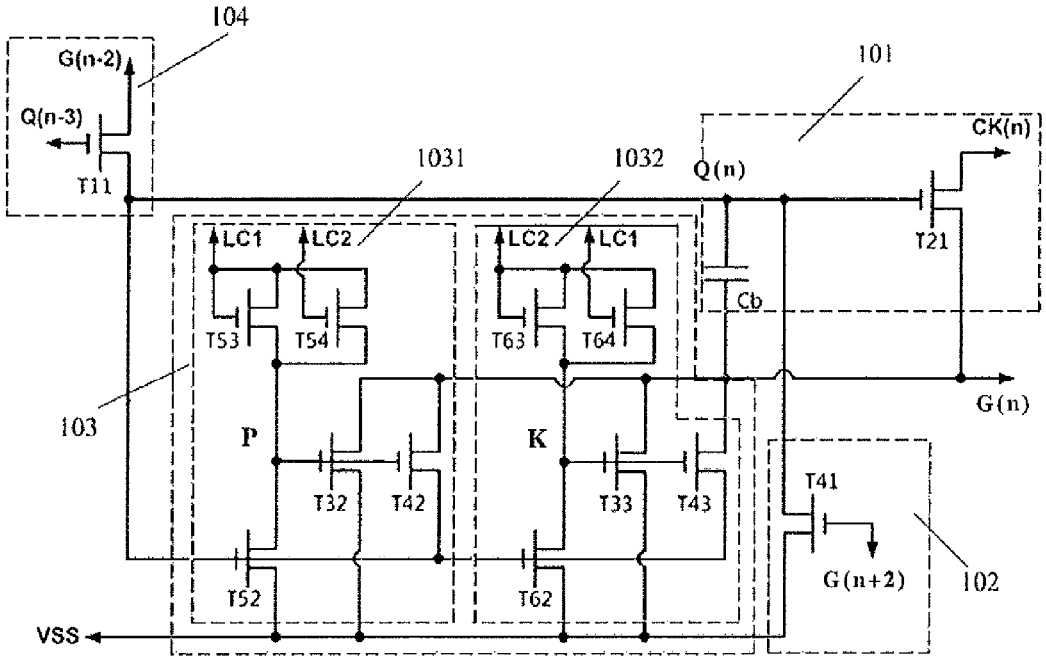
FIG. 1 is a schematic view of a structure of a row driving circuit for an array substrate according to a preferred embodiment of the present invention.

FIG. 1 is a schematic view of a structure of a row driving circuit for an array substrate according to a first embodiment of the present invention.

The row driving circuit for an array substrate comprises array substrate row driving units with multi-stage connections. An n-th stage array substrate row driving unit in the row driving circuit for the array substrate comprises an (n−3)-th stage signal input terminal, an (n−2)-th stage signal input terminal, an (n+2)-th stage signal input terminal, a first output terminal, a second output terminal, a low level input terminal, and a high frequency clock signal input terminal, and n is a positive integer greater than 3.

In the n-th stage array substrate row driving unit, the (n−3)-th stage signal input terminal is connected to the second output terminal of an (n−3)-th stage array substrate row driving unit, the (n−2)-th stage signal input terminal is connected to the first output terminal of an (n−2)-th stage array substrate row driving unit, the (n+2)-th signal input terminal is connected to the first output terminal of an (n+2)-th stage array substrate row driving unit, the second output terminal is connected to an (n−3)-th stage signal input terminal of an (n+3)-th stage array substrate row driving unit, and the first output terminal is connected to an (n−2)-th stage signal input terminal of an (n+2)-th stage array substrate row driving unit and an (n+2)-th stage signal input terminal of an (n−2) stage array substrate row driving unit for providing a scanning signal to an n-th stage horizontal scanning line of a display area.

It should be appreciated that the (n−3)-th stage signal input terminal is Q(n−3) and the Q(n−3) is a signal of the second output terminal of the (n−3)-th stage row driving circuit for an array substrate in the n-th stage array substrate row driving unit of the present invention. The (n−2)-th stage signal input terminal is G(n−2), and G(n−2) is a signal of the first output terminal of the (n−2)-th stage row driving circuit for an array substrate. The (n+2)-th stage signal input terminal is G(n+2), and the G(n+2) is a signal of the first output terminal of the (n+2)-th stage row driving circuit for an array substrate. A signal of the first output terminal is G(n), and a signal of the second output terminal is Q(n). A signal of the low level input terminal is Vss, and a signal of the high frequency clock signal input terminal is CK(n).

The n-th stage array substrate row driving unit further comprises:

A pull-up controlling unit 104 which includes a first thin film transistor, and the first thin film transistor is connected to the (n−3)-th stage signal input terminal, the (n−2)-th stage signal input terminal, and the second output terminal. A peak voltage of the (n−3)-th stage signal input terminal is twice a peak voltage of the (n−2)-th stage signal input terminal for pulling up an electric potential of the second output terminal.

A pull-up unit 101 is connected to the high frequency clock signal input terminal and the first output terminal. The pull-up controlling unit 104 and the pull-up unit are connected to the second output terminal for charging a signal of the first output terminal, and thus the second output terminal has a higher electric potential.

The low level input terminal, the pull-up controlling unit 104, and the pull-up unit 101 are connected to a pull-down controlling unit 103 for keeping a low electric potential of the second output terminal and the first output terminal when the signal of the first output terminal is non-chargeable.

The (n+2)-th stage signal input terminal, the low level input terminal, and the pull-down controlling unit 103 are connected to a pull-down unit 102, and the pull-down unit 102, the pull-up unit 101, and the pull-up controlling unit 104 are connected to the second output terminal for pulling down an electric potential of the second output terminal.

It should be appreciated that the (n−3)-th stage signal input terminal and the (n−2)-th stage signal input terminal are inputted by a pulse activation signal in the 1 th stage array substrate row driving unit. The (n+2)-th stage signal input terminal is connected to the first output terminal of the 3th stage array substrate row driving unit. The second output terminal is connected to the (n−3)-th stage signal input terminal of the 4th stage array substrate row driving unit. The first output terminal is connected to the (n−2)-th stage signal input terminal of the 3th stage array substrate row driving unit for providing a scanning signal to the 1th stage horizontal scanning line of a display area. The processes of the 2th stage array substrate row driving unit and the 3th stage array substrate row driving unit are similar to the above, and here requires no specific description.

The reciprocal 1th stage signal input terminal and the (n+2) stage signal input terminal are inputted by a pulse activation signal, and the second output terminal is vacant. The processes of the reciprocal 2th stage array substrate row driving unit and the 3th stage array substrate row driving unit are similar to the above, and here requires no specific description.

Specific structures of the internal connection of the pull-up controlling unit 104, the pull-up unit 101, the pull-down controlling unit 103, and the pull-down unit 102 are described as follows.

The pull-up controlling unit 104 is a first thin film transistor T11, and the first thin film transistor T11 comprises a first gate electrode, a first source electrode, and a first drain electrode.

The first gate electrode is connected to the (n−3)-th stage signal input terminal. The first source electrode is connected to the (n−2)-th stage signal input terminal. The first drain electrode is connected to a pull-down controlling unit 103. The first drain electrode, a pull-down unit 102, and a pull-up unit 101 are connected to the second output terminal.

The pull-up unit 101 includes a capacitor Cb and a second thin film transistor T21. The second thin film transistor T21 comprises a second gate electrode, a second source electrode and a second drain electrode, and the capacitor Cb comprises a first electrode plate and a second electrode plate.

The second gate electrode is connected to the pull-up controlling unit 104 and the first electrode plate of the capacitor Cb through the second output terminal. The second source electrode is connected to the high frequency clock signal input terminal. The second drain electrode is connected to the first output terminal.

The pull-down controlling unit 103 comprises a first pull-down controlling sub-unit 1031. The first pull-down controlling sub-unit 1031 comprises a third thin film transistor T52. The third thin film transistor T52 comprises a third gate electrode, a third source electrode, and a third drain electrode.

The third gate electrode is connected to the first drain electrode. The third drain is connected to the low level input terminal.

The first pull-down controlling sub-unit 1031 further comprises a fourth thin film transistor T32 and a fifth thin film transistor T42. The fourth thin film transistor T32 comprises a fourth gate electrode, a fourth source electrode, and a fourth drain electrode. The fifth thin film transistor T42 comprises a fifth gate electrode, a fifth source electrode, and a fifth drain electrode.

The fourth gate electrode and the fifth gate electrode are connected to the third source electrode. The fourth source electrode and the fifth source electrode are connected to the second electrode plate of the capacitor Cb and the first output terminal. The fourth drain electrode is connected to the low level input terminal. The fifth drain is connected to the third gate electrode.

Referring to FIG. 1, the n-th stage array substrate row driving unit further comprises a low frequency clock signal first input terminal and a low frequency clock signal second input terminal.

A signal of the low frequency clock signal first input terminal is LC1, and a signal of the low frequency clock signal second input terminal is LC2.

The first pull-down controlling sub-unit 1031 further comprises a sixth thin film transistor T53 and a seventh thin film transistor T54. The sixth thin film transistor T53 comprises a sixth gate electrode, a sixth source electrode, and a sixth drain electrode. The seventh thin film transistor T54 comprises a seventh gate electrode, a seventh source electrode, and a seventh drain electrode.

The sixth gate electrode, the six source electrode, and the seventh source electrode are connected to the low frequency clock signal first input terminal. The seventh gate electrode is connected to the low frequency clock signal second input terminal. The sixth drain electrode and the seventh drain are connected to the fourth gate electrode.

The n-th stage array substrate row driving unit further comprises a second pull-down controlling sub-unit 1032. The second pull-down controlling sub-unit 1032 comprises an eighth thin film transistor T62. The eighth thin film transistor T62 comprises an eighth gate electrode, an eighth source electrode, and an eighth drain electrode.

The eighth gate electrode is connected to the first drain electrode. The eighth drain electrode is connected to the low level input terminal.

The second pull-down controlling sub-unit 1032 further comprises a ninth thin film transistor T33 and a tenth thin film transistor T43. The ninth thin film transistor T33 comprises a ninth gate electrode, a ninth source electrode, and a ninth drain electrode. The tenth thin film transistor comprises T43 a tenth gate electrode, a tenth source electrode, and a tenth drain electrode.

The ninth gate electrode and the tenth gate electrode are connected to the eighth source electrode. The ninth source electrode and the tenth source electrode are connected to the fourth source electrode, the fifth source electrode, the second electrode plate of the capacitor Cb, and the first output terminal. The ninth drain electrode is connected to the low level input terminal. The tenth drain electrode is connected to the eighth gate electrode.

The second pull-down controlling sub-unit 1032 further comprises an eleventh thin film transistor T63 and twelfth thin film transistor T64. The eleventh thin film transistor T63 comprises an eleventh gate electrode, an eleventh source electrode, and an eleventh drain electrode. The twelfth thin film transistor T64 comprises a twelfth gate electrode, a twelfth source electrode, and a twelfth drain electrode.

The eleventh gate electrode, the eleventh source electrode, and the twelfth source electrode are connected to the low frequency clock signal second input terminal. The twelfth gate electrode is connected to the low frequency clock signal first input terminal. The eleventh drain electrode and the twelfth drain electrode are connected to the ninth gate electrode.

The pull-down unit 102 is a thirteenth thin film transistor T41. The thirteenth thin film transistor T41 comprises a thirteenth gate electrode, a thirteenth source electrode, and a thirteenth drain electrode.

The thirteenth gate electrode is connected to the (n+2)-th stage signal input terminal. The thirteenth drain electrode is connected to the low level input terminal. The thirteenth source electrode is connected to the second gate electrode.

It should be appreciated that the connection or the disconnection of each of the thin film transistors corresponds to the connection or the disconnection between the source electrode and drain electrode.

In the embodiment of the present invention, the first thin film transistor T11, the second thin film transistor T21, the third thin film transistor T52, the fourth thin film transistor T32, the fifth thin film transistor T42, the sixth thin film transistor T53, the seventh thin film transistor T54, the eighth thin film transistor T62, the ninth thin film transistor T33, the tenth thin film transistor T43, the eleventh thin film transistor T63, the twelfth thin film transistor T64, and the thirteenth thin film transistor T41 are N-type thin film transistors. The thin film transistors can also be P-type thin film transistors in other embodiments. The type of the thin film transistor is determined by the specific situation, and the scope of present invention is not limited.

To better understand the technical features of the present invention, the row driving circuit for an array substrate (Gate driver On array, GOA) of a preferred embodiment of the present invention in FIG. 1 is a single-stage architecture, and is described as follows.

The single-stage GOA circuit comprises a second thin film transistor T21 (the pull-up unit 101 in FIG. 1) for charging the n-th stage horizontal scanning line of a display area. The first output terminal (G(n) signal output terminal) is connected to the n-th stage horizontal scanning line. The second source electrode and the second drain electrode of the second thin film transistor T21 are connected to the first output terminal and the high frequency clock signal input terminal (CK(n) signal output terminal). The second gate electrode of the second thin film transistor T21 is connected to the second output terminal. The electric potential of Q(n) influences CK(n) charging to G(n). The GOA circuit further comprises a thirteenth thin film transistor T41 (the pull-up controlling unit 104 in FIG. 1). The thirteenth thin film transistor T41 discharges to Q(n) when the charging of G(n) is completed.

Referring to FIG. 1, the pull-down controlling unit 103 is a pull-down area of the GOA circuit, and G(n) and Q(n) can be kept at a low electric potential during a non-chargeable period.

Point P and point K of the pull-down controlling unit 103 are charged by the low frequency clock signal first input terminal LC1 and the low frequency clock signal second input terminal LC2, and are kept at a high electric potential. The fourth thin film transistor T32 and fifth thin film transistor T42 are controlled or the ninth thin film transistor T33 and tenth thin film transistor T43 are turned on. Thus, the thin film transistor can avoid being influenced by the stress of the gate voltage.

The third thin film transistor T52 is connected to the point P and the low level input terminal (signal input terminal Vss). The eighth thin film transistor T62 is connected the point K and the low level input terminal. The third thin film transistor T52 and the eighth thin film transistor T62 are turned on when Q(n) is a high electric potential. The electric potential of point P and point K are pulled down to turn off the fourth thin film transistor T32, the fifth thin film transistor T42, the ninth thin film transistor T33, and the tenth thin film transistor T43. Thus, the charging of G(n) is not affected.

The first thin film transistor T11 (the pull-up controlling unit 104 in FIG. 1) can be controlled to deliver a signal from the previous stage of the GOA circuit, and thus the signal can be delivered stage by stage. The capacitor Cb is connected between Q(n) and G(n). The electric potential of Q(n) is increased by coupling with the capacitor Cb when the electric potential of G(n) is increased. Thus, the electric potential of Q(n) can be higher and the charging signal of GOA can be Reduced.

In the embodiment, each of the switches is an N-Type thin film transistor, and the work of the single-stage GOA circuit is described as follows.

Figure 2:
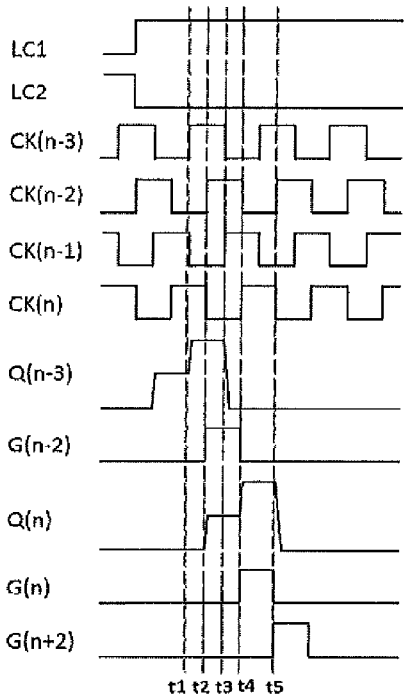
FIG. 2 is a schematic view of a structure of the time sequence of a row driving circuit for an array substrate according to a preferred embodiment of the present invention.

FIG. 2 is a schematic view of a structure of the time sequence of a row driving circuit for an array substrate. The time sequence has three stages. The preparation time before the charging of G(n) is t1~t4, the charging time of G(n) is t4~t5, and the discharging time of G(n) is after t5.

When the time is t1, CK(n−3) is a high electric potential, and Q(n−3) is boosted up to a high electric potential. The high electric potential of Q(n−3) is twice the high electric potential of G(n−2). G(n−2) is a low electric potential. Q(n) is non-chargeable, and Q(n) is a low electric potential.

The CK(n−3) is a high frequency clock signal of the (n−3)-th stage array substrate row driving unit, and Q(n−3) is boosted up to a high electric potential when CK(n−3) is a high electric potential.

When the time is t2, the potential of CK(n−2) is increased, and the potential of G(n−2) is increased. Q(n−3) is still kept the high electric potential (higher than the high electric potential of G(n−2)). Q(n) is charged by connecting to the first thin film transistor T11, and the electric potential of Q(n) is increased.

CK(n−2) is a high frequency clock signal of the (n−2)-th stage array substrate row driving unit.

After the electric potential of Q(n) has increased, the third thin film transistor T52 and eighth thin film transistor T62 are turned on. The fourth thin film transistor T32, the fifth thin film transistor T42, the ninth thin film transistor T33, and tenth the fifth thin film transistor T43 are turned off by pulling down the electric potential of point P and point K. Thus, the charging of G(n) is not affected.

If point P and point K are high electric potentials, the fourth thin film transistor T32 and the fifth thin film transistor T42 are turned on, or the ninth thin film transistor T33 and the tenth thin film transistor T43 are turned on. Thus, the electric potential of G(n) and Q(n) are pulled down, affecting the charging.

When the time is t3, the electric potential of CK(n−3) is decreased, and the electric potential of Q(n−3) is decreased. G(n−2) is kept a high electric potential, and the electric potential of Q(n) is unchanged.

When the time is t4, the electric potential of CK(n) is increased, and the second thin film transistor T21 is turned on. The electric potential of Q(n) is boosted up higher. G(n) is charged by the second thin film transistor T21, and the electric potential of G(n) is increased.

When the time is t5, the electric potential of CK(n) is decreased. The electric potential of Q(n) is not pulled down Immediately. The second thin film transistor T21 is still turned on after t5, and the electric potential of G(n) is pulled down.

Then, the electric potential of G(n+2) is increased. The thirteenth thin film transistor T41 is turned on, and the electric potential of Q(n) is pulled down to a low electric potential. The third thin film transistor T52 and the eighth thin film transistor T62 are turned off after pulling down the electric potential of Q(n). The switch of the third thin film transistor T52 and the eighth thin film transistor T62 and the switch of the ninth thin film transistor T33 and tenth thin film transistor T43 are alternately turned on to keep the electric potential of G(n) and Q(n) low during the non-chargeable period.

The electric potential of point P and point K can be affected by the low frequency signals LC1 and LC2 when the third thin film transistor T52 and the eighth thin film transistor T62 are turned off. When LC1 is a high electric potential and LC2 is a low electric potential, the sixth thin film transistor T53 is turned on, and seventh thin film transistor T54 is turned off. Point P can be a high electric potential, and the fourth thin film transistor T32 and fifth thin film transistor T42 are turned on. When LC2 is a high electric potential and LC1 is a low electric potential, the eleventh thin film transistor T63 is turned on, and the twelfth thin film transistor T64 is turned off. Point K can be a high electric potential, and the ninth thin film transistor T33 and tenth thin film transistor T43 are turned on. This design can avoid the influence of the stress of the gate voltage, thereby extending the life of the elements.

Referring to FIG. 1, the first thin film transistor T11 of the GOA circuit of the present invention delivers the signal between the previous stage and the next stage. The first gate electrode is connected to the (n−3)-th signal input terminal (signal Q(n−3)). The first source electrode is connected to the (n−2)-th signal input terminal (signal G(n−2)). The first drain electrode is connected to the second output terminal (signal Q(n)). If Q(n) is charged from the first thin film transistor T11, Vgs between the first gate electrode and the first source electrode is not less than Vth (Vgs-Vth≥0).

The electric potential of signal Q(n−3) of the first gate electron is twice the high electric potential $V_{G(n-2)}$ of G(n−2) after booting up. Q(n) can be charged to $V_{G(n-2)}$ from the first thin film transistor T11. The electric potential of Q(n) is not affected by the threshold voltage Vth of the first thin film transistor T11.

As stated above, the first thin film transistor of the GOA circuit of the present invention is controlled by the signal Q(n−3) to deliver the signal between the previous stage and next stage. Thus, the output of the GOA circuit can avoid being affected by the threshold voltage shift of the TFT elements, and the stability of the output can be improved.

The present invention also provides a liquid crystal display device that comprises an row driving circuit for the array substrate for providing a preferred embodiments of the row driving circuit for the array substrate.

The liquid crystal display device of the embodiment of the present invention comprises a row driving circuit for the array substrate and a display area connected to the array substrate row driving circuit. The array substrate row driving circuit comprises array substrate row driving units with multi-stage connections.

An n-th stage array substrate row driving unit in the row driving circuit for the array substrate comprises an (n−3)-th stage signal input terminal, an (n−2)-th stage signal input terminal, an (n+2)-th stage signal input terminal, a first output terminal, a second output terminal, a low level input terminal, and a high frequency clock signal input terminal, wherein n is a positive integer greater than 3.

The (n−3)-th stage signal input terminal is connected to the second output terminal of a (n−3)-th stage array substrate row driving unit. The (n−2)-th stage signal input terminal is connected to the first output terminal of a (n−2)-th stage array substrate row driving unit. The (n+2)-th signal input terminal is connected to the first output terminal of a (n+2)-th stage array substrate row driving unit. The second output terminal is connected to a (n−3)-th stage signal input terminal of a (n+3)-th stage array substrate row driving unit. The first output terminal is connected to a (n−2)-th stage signal input terminal of a (n+2)-th stage array substrate row driving unit and a (n+2)-th stage signal input terminal of a (n−2)-th stage array substrate row driving unit for providing a scanning signal to a n-th stage horizontal scanning line of a display area.

It should be appreciated that the (n−3)-th stage signal input terminal is Q(n−3), and the Q(n−3) is a signal of the second output terminal of the (n−3)-th stage row driving circuit for an array substrate in the n-th stage array substrate row driving unit of the present invention. The (n−2)-th stage signal input terminal is G(n−2), and the G(n−2) is a signal of the first output terminal of the (n−2)-th stage row driving circuit for an array substrate. The (n+2)-th stage signal input terminal is G(n+2), and the G(n+2) is a signal of the first output terminal of the (n+2)-th stage row driving circuit for an array substrate. A signal of the first output terminal is G(n), and a signal of the second output terminal is Q(n). A signal of the low level input terminal is Vss, and a signal of the high frequency clock signal input terminal is CK(n).

The n-th stage array substrate row driving unit further comprises:

A pull-up controlling unit 104 which includes a first thin film transistor, and the first thin film transistor is connected to the (n−3)-th stage signal input terminal, the (n−2)-th stage signal input terminal, and the second output terminal. A peak voltage of the (n−3)-th stage signal input terminal is twice a peak voltage of the (n−2)-th stage signal input terminal for pulling up an electric potential of the second output terminal.

A pull-up unit 101 is connected to the high frequency clock signal input terminal and the first output terminal. The pull-up controlling unit 104 and the pull-up unit are connected to the second output terminal for charging a signal of the first output terminal, and thus the second output terminal has a higher electric potential.

The low level input terminal, the pull-up controlling unit 104, and the pull-up unit 101 are connected to a pull-down controlling unit 103 for keeping a low electric potential of the second output terminal and the first output terminal when the signal of the first output terminal is non-chargeable.

The (n+2)-th stage signal input terminal, the low level input terminal, and the pull-down controlling unit 103 are connected to a pull-down unit 102, and the pull-down unit 102; the pull-up unit 101 and the pull-up controlling unit 104 are connected to the second output terminal for pulling down an electric potential of the second output terminal.

Figure 3:
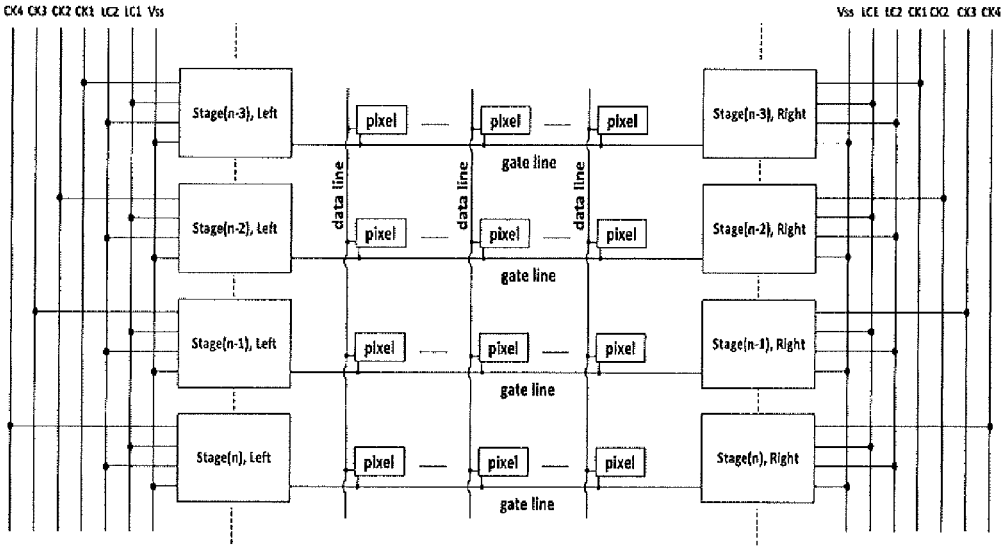
FIG. 3 is a schematic view of another structure of a row driving circuit for an array substrate according to a preferred embodiment of the present invention.

FIG. 3 is a schematic view of a GOA circuit with multi-stage connections of the present invention. A display area has horizontal scanning lines, and two ends of each scanning line are connected the array substrate row driving units respectively, the horizontal scanning lines are connected to the first output terminal of the array substrate row driving units.

The GOA circuit can charge and discharge the horizontal scanning line (gate line) from the right side and the left side. The low frequency clock signal first and second input terminals LC1, LC2, DC low voltage Vss, and the high frequency clock signal metal wires CK1~CK4 are disposed on the periphery of each GOA circuit. The n-th stage GOA circuit receives one signal of LC1, LC2, Vss, CK1 to CK4, a signal G(n−2) of the (n−2)-th stage GOA circuit, a signal Q(n−3)-th of the (n−3)-th stage GOA circuit, and a signal G(n+2)-th of the (n+2)-th stage GOA circuit, and produces the signal G(n) and the signal Q(n). Referring to FIG. 3, the multi-stage connection structure ensures that the signal of the GOA is delivered stage by stage. Each GOA circuit can charge and discharge the horizontal scanning line of the display area from the right side and the left side.

The specific structures of the internal connections of the pull-up controlling unit 104, the pull-up unit 101, the pull-down controlling unit 103, and the pull-down unit 102 are described as follows.

The pull-up controlling unit 104 is a first thin film transistor T11, and the first thin film transistor T11 comprises a first gate electrode, a first source electrode, and a first drain electrode.

The first gate electrode is connected to the (n−3)-th stage signal input terminal. The first source electrode is connected to the (n−2)-th stage signal input terminal. The first drain electrode is connected to a pull-down controlling unit 103. The first drain electrode, a pull-down unit 102, and a pull-up unit 101 are connected to the second output terminal.

The pull-up unit 101 includes a capacitor Cb and a second thin film transistor T21. The second thin film transistor T21 comprises a second gate electrode, a second source electrode, and a second drain electrode; the capacitor Cb comprises a first electrode plate and a second electrode plate.

The second gate electrode is connected to the pull-up controlling unit 104 and the first electrode plate of the capacitor Cb through the second output terminal. The second source electrode is connected to the high frequency clock signal input terminal. The second drain electrode is connected to the first output terminal.

The pull-down controlling unit 103 comprises a first pull-down controlling sub-unit 1031. The first pull-down controlling sub-unit 1031 comprises a third thin film transistor T52. The third thin film transistor T52 comprises a third gate electrode, a third source electrode, and a third drain electrode.

The third gate electrode is connected to the first drain electrode. The third drain is connected to the low level input terminal.

The first pull-down controlling sub-unit 1031 further comprises a fourth thin film transistor T32 and a fifth thin film transistor T42. The fourth thin film transistor T32 comprises a fourth gate electrode, a fourth source electrode, and a fourth drain electrode. The fifth thin film transistor T42 comprises a fifth gate electrode, a fifth source electrode, and a fifth drain electrode.

The fourth gate electrode and the fifth gate electrode are connected to the third source electrode. The fourth source electrode and the fifth source electrode are connected to the second electrode plate of the capacitor Cb and the first output terminal. The fourth drain electrode is connected to the low level input terminal. The fifth drain is connected to the third gate electrode.

Referring to FIG. 1, the n-th stage array substrate row driving unit further comprises a low frequency clock signal first input terminal and a low frequency clock signal second input terminal.

A signal of the low frequency clock signal first input terminal is LC1, and a signal of the low frequency clock signal second input terminal is LC2.

The first pull-down controlling sub-unit 1031 further comprises a sixth thin film transistor T53 and a seventh thin film transistor T54. The sixth thin film transistor T53 comprises a sixth gate electrode, a sixth source electrode, and a sixth drain electrode. The seventh thin film transistor T54 comprises a seventh gate electrode, a seventh source electrode, and a seventh drain electrode.

The sixth gate electrode, the six source electrode, and the seventh source electrode are connected to the low frequency clock signal first input terminal. The seventh gate electrode is connected to the low frequency clock signal second input terminal. The sixth drain electrode and the seventh drain are connected to the fourth gate electrode.

The n-th stage array substrate row driving unit further comprises a second pull-down controlling sub-unit 1032. The second pull-down controlling sub-unit 1032 comprises an eighth thin film transistor T62. The eighth thin film transistor T62 comprises an eighth gate electrode, an eighth source electrode, and an eighth drain electrode.

The eighth gate electrode is connected to the first drain electrode. The eighth drain electrode is connected to the low level input terminal.

The second pull-down controlling sub-unit 1032 further comprises a ninth thin film transistor T33 and a tenth thin film transistor T43. The ninth thin film transistor T33 comprises a ninth gate electrode, a ninth source electrode, and a ninth drain electrode. The tenth thin film transistor comprises T43 a tenth gate electrode, a tenth source electrode, and a tenth drain electrode.

The ninth gate electrode and the tenth gate electrode are connected to the eighth source electrode. The ninth source electrode and the tenth source electrode are connected to the fourth source electrode, the fifth source electrode, the second electrode plate of the capacitor Cb and the first output terminal. The ninth drain electrode is connected to the low level input terminal. The tenth drain electrode is connected to the eighth gate electrode.

The second pull-down controlling sub-unit 1032 further comprises an eleventh thin film transistor T63 and twelfth thin film transistor T64. The eleventh thin film transistor T63 comprises an eleventh gate electrode, an eleventh source electrode, and an eleventh drain electrode. The twelfth thin film transistor T64 comprises a twelfth gate electrode, a twelfth source electrode, and a twelfth drain electrode.

The eleventh gate electrode, the eleventh source electrode, and the twelfth source electrode are connected to the low frequency clock signal second input terminal. The twelfth gate electrode is connected to the low frequency clock signal first input terminal. The eleventh drain electrode and the twelfth drain electrode are connected to the ninth gate electrode.

The pull-down unit 102 is a thirteenth thin film transistor T41. The thirteenth thin film transistor T41 comprises a thirteenth gate electrode, a thirteenth source electrode, and a thirteenth drain electrode.

The thirteenth gate electrode is connected to the (n+2)-th stage signal input terminal. The thirteenth drain electrode is connected to the low level input terminal. The thirteenth source electrode is connected to the second gate electrode.

Referring to FIG. 2, the preparation time before the charging of G(n) is t1~t4, the charging time of G(n) is t4~t5, and the discharging time of G(n) is after t5.

When the time is t1, CK(n−3) is a high electric potential, and Q(n−3) is boosted up to a high electric potential. The high electric potential of Q(n−3) is twice the high electric potential of G(n−2). G(n−2) is a low electric potential. Q(n) is non-chargeable, and Q(n) is a low electric potential.

When the time is t2, the potential of CK(n−2) is increased, and the potential of G(n−2) is increased. Q(n−3) is still kept at a high electric potential (higher than the high electric potential of G(n−2)). Q(n) is charged by connecting to the first thin film transistor T11, and the electric potential of Q(n) is increased.

After the electric potential of Q(n) increased, the third thin film transistor T52 and eighth thin film transistor T62 are turned on. The fourth thin film transistor T32, the fifth thin film transistor T42, the ninth thin film transistor T33, and tenth the fifth thin film transistor T43 are turned off by pulling down the electric potential of point P and point K. Thus, the charging of G(n) is not affected.

When the time is t3, the electric potential of CK(n−3) is decreased, and the electric potential of Q(n−3) is decreased. G(n−2) is maintained at a high electric potential, and the electric potential of Q(n) is unchanged.

When the time is t4, the electric potential of CK(n) is increased, and the second thin film transistor T21 is turned on. The electric potential of Q(n) is boosted up higher. G(n) is charged by the second thin film transistor T21, and the electric potential of G(n) is increased.

When the time is t5, the electric potential of CK(n) is decreased. The electric potential of Q(n) is not pulled down immediately. The second thin film transistor T21 is still turned on after t5, and the electric potential of G(n) is pulled down.

Then, the electric potential of G(n+2) is increased. The thirteenth thin film transistor T41 is turned on, and the electric potential of Q(n) is pulled down to a low electric potential. The third thin film transistor T52 and the eighth thin film transistor T62 are turned off after pulling down the electric potential of Q(n). The switch of the third thin film transistor T52 and the eighth thin film transistor T62 and the switch of the ninth thin film transistor T33 and tenth thin film transistor T43 are alternately turned on to keep the low electric potential of G(n) and Q(n) low during the non-chargeable period.

In the embodiment, the first thin film transistor of the GOA circuit of the present invention is controlled by the signal Q(n−3) to deliver the signal between the previous stage and next stage. Thus, the output of the GOA circuit can avoid being affected by the threshold voltage shift of the TFT elements, and the stability of the output can be improved.

Figure 4:
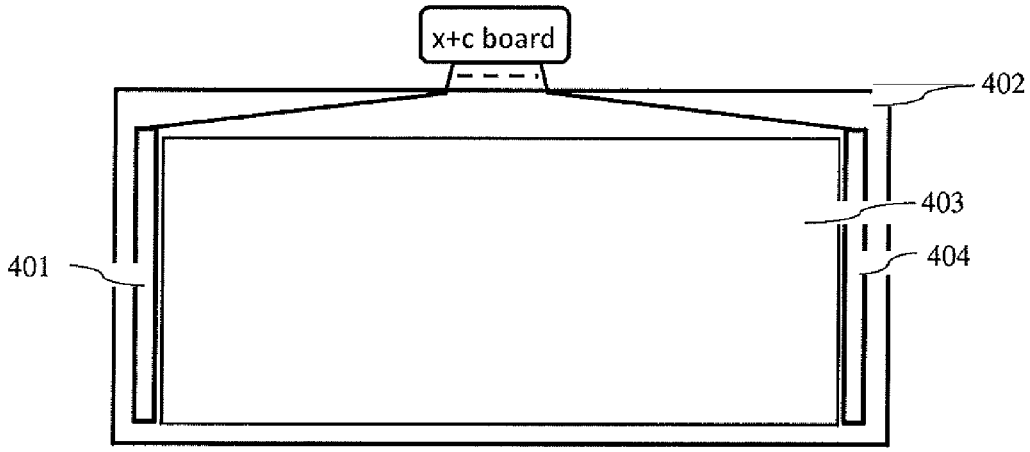
FIG. 4 is a schematic view of another structure of a liquid crystal display device according to a preferred embodiment of the present invention.

Referring to FIG. 4, the GOA circuit of the present invention can be adopted in a display panel. FIG. 4 is a schematic view of another structure of a liquid crystal display device of the present invention. The x+c board is a display board on a display area 403, and is provides a driving signal and a controlling signal. An area 402 is a display device case. The GOA circuit is provided on an area 401 and an area 404. The area 401 is located on the left side of the display board, and the area 404 is located on the right side of the display board. The horizontal scanning line of the display area 403 can be driven from the left side or the right side.

The GOA circuit receives the input signal of the x+c board, and produces controlling signals of the horizontal scanning line to turn on the pixels in the display area 403.

The GOA circuit of the present invention and a traditional GOA circuit will now be compared so as to provide a clearer understanding of the present invention.

Figure 5A:
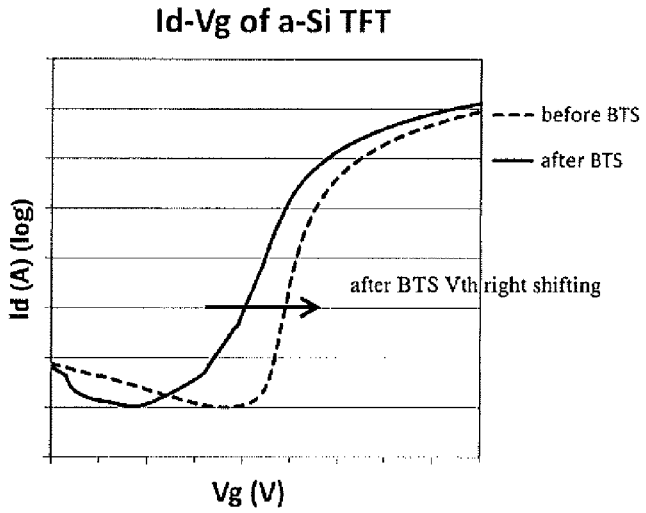
FIGS. 5*a*, 5*b*, and 5*c* are schematic views of output signals of the GOA circuit.
Figure 5B:
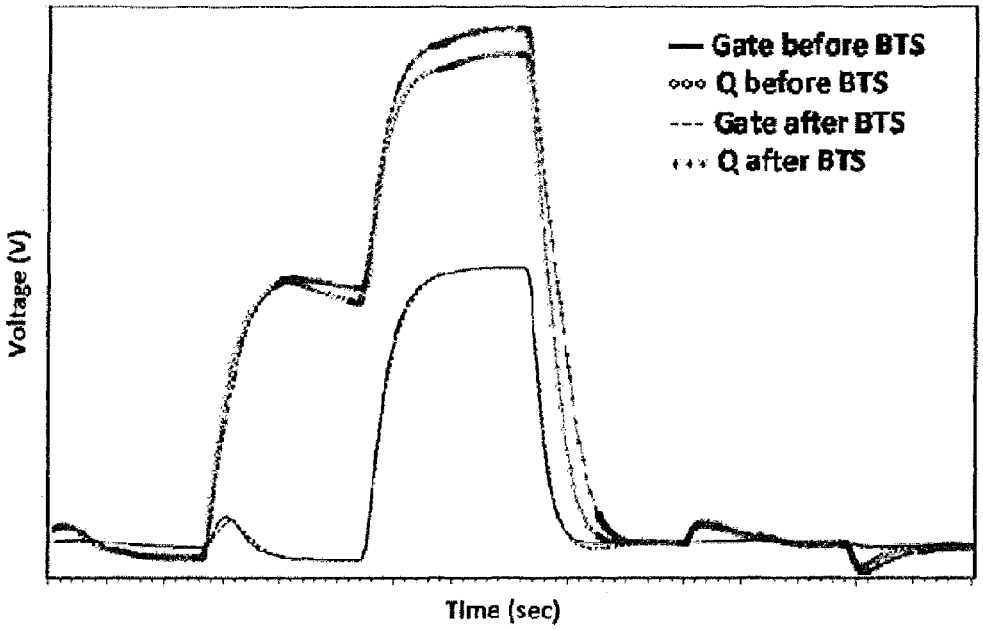
Figure 5C:
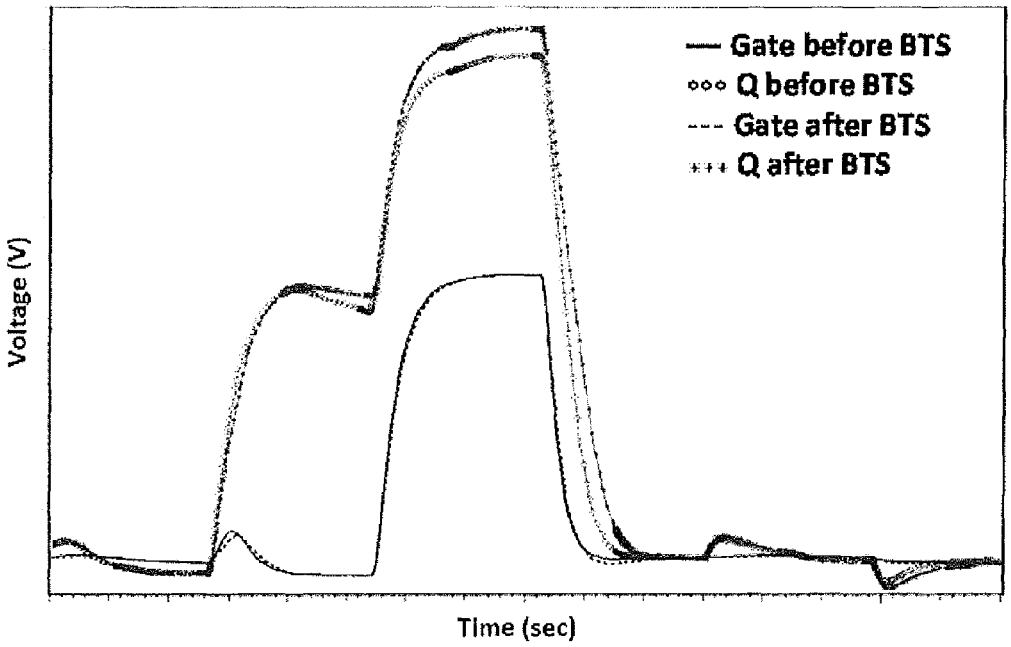

FIGS. 5*a* to 5*c* are schematic views of the output signals of the GOA circuit. For example, in a traditional GOA circuit, a peak potential of the gate of the first thin film transistor T11 of the pull-up controlling unit 104 is twice the potential $V_{G(n-2)}$ of G(n−2). Q(n) can be charged to $V_{G(n-2)}$-Vth by the first thin film transistor T11. In FIG. 5*a*, the threshold voltage shifts of the TFT are compared between the GOA circuit of the present invention and the traditional GOA circuit. The dotted line is before BTS (bias temperature stress), and the solid is after BTS. The threshold voltage Vth of TFT can right shift. FIGS. 5*b* and 5*c* are simulated by collecting the electrical parameters before BTS and after BTS. The change in the output of Q(n) and G(n) of the traditional GOA circuit is drastic after the threshold voltage shift of the TFT, as is shown in FIG. 5*b*. The change in the output of Q(n) and G(n) of the GOA circuit of the present invention is small after the threshold voltage shift of the TFT, as is shown in FIG. 5*c*.

As stated above, the first thin film transistor of the GOA circuit of the present invention is controlled by the signal Q(n−3) to deliver the signal between the previous stage and next stage. Thus, the output of the GOA circuit can avoid being affected by the threshold voltage shift of the TFT elements, and the stability of the output can be improved. The GOA circuit of the present invention can be adopted in a display panel.

The structure and the technical means adopted by the present invention to achieve the above and other objects can be best understood by referring to the following detailed description of the preferred embodiments and the accompanying drawings. Furthermore, directional terms described by the present invention, such as upper, lower, front, back, left, right, inner, outer, side, longitudinal/vertical, transverse/horizontal, and etc., are only directions by referring to the accompanying drawings, and thus the used directional terms are used to describe and understand the present invention, but the present invention is not limited.

The present invention has been described with a preferred embodiment thereof and it is understood that many changes and modifications to the described embodiment can be carried out without departing from the scope and the spirit of the invention that is intended to be limited only by the appended claims.

What is claimed is:

1. A row driving circuit for an array substrate, comprising array substrate row driving units with multi-stage connections, wherein an n-th stage array substrate row driving unit in the row driving circuit for the array substrate comprises:

an (n−3)-th stage signal input terminal, an (n−2)-th stage signal input terminal, an (n+2)-th stage signal input terminal, a first output terminal, a second output terminal, a low level input terminal, and a high frequency clock signal input terminal, wherein n is a positive integer greater than 3;

wherein the (n−3)-th stage signal input terminal is connected to the second output terminal of an (n−3)-th stage array substrate row driving unit, and the (n−2)-th stage signal input terminal is connected to the first output terminal of an (n−2)-th stage array substrate row driving unit, and the (n+2)-th signal input terminal is connected to the first output terminal of an (n+2)-th stage array substrate row driving unit, and the second output terminal is connected to an (n−3)-th stage signal input terminal of an (n+3)-th stage array substrate row driving unit, and the first output terminal is connected to an (n−2)-th stage signal input terminal of a (n+2)-th stage array substrate row driving unit and an (n+2)-th stage signal input terminal of an (n−2) stage array substrate row driving unit for providing a scanning signal to an n-th stage scanning line of a display area;

wherein the n-th stage array substrate row driving unit further comprises:

a pull-up controlling unit including a first thin film transistor, wherein the first thin film transistor comprises a first gate electrode, a first source electrode, and a first drain electrode, and the first gate electrode is connected to the (n−3)-th stage signal input terminal, and the first source electrode is connected to the (n−2)-th stage signal input terminal, the first drain electrode is connected to a pull-down controlling unit, and the first drain electrode, a pull-down unit, and a pull-up unit are connected to the second output terminal, and a peak voltage of the (n−3)-th stage signal input terminal is twice a peak voltage of the (n−2)-th stage signal input terminal for pulling up an electric potential of the second output terminal;

wherein the pull-up unit includes a capacitor and a second thin film transistor, and the second thin film transistor comprises a second gate electrode, a second source electrode, and a second drain electrode, and the capacitor comprises a first electrode plate and a second electrode plate, and the second gate electrode is connected to the pull-up controlling unit and the first electrode plate of the capacitor through the second output terminal, the second source electrode is connected to the high frequency clock signal input terminal, and the second drain electrode is connected to the first output terminal for charging a signal of the first output terminal, and thereby the second output terminal has a higher electric potential;

wherein the low level input terminal, the pull-up controlling unit, and the pull-up unit are connected to the pull-down controlling unit for maintaining a low electric potential of the second output terminal and the first output terminal when the signal of the first output terminal is non-chargeable;

wherein the (n+2)-th stage signal input terminal, the low level input terminal, and the pull-down controlling unit are connected to the pull-down unit, and the pull-down unit, the pull-up unit, and the pull-up controlling unit are connected to the second output terminal for pulling down an electric potential of the second output terminal.

2. The row driving circuit according to claim 1, wherein the pull-down controlling unit comprises a first pull-down controlling sub-unit, the first pull-down controlling sub-unit comprises a third thin film transistor, and the third thin film transistor comprises a third gate electrode, a third source electrode, and a third drain electrode, the third gate electrode is connected to the first drain electrode, and the third drain is connected to the low level input terminal;

wherein the first pull-down controlling sub-unit further comprises a fourth thin film transistor and a fifth thin film transistor, the fourth thin film transistor comprises a fourth gate electrode, a fourth source electrode, and a fourth drain electrode, and the fifth thin film transistor comprises a fifth gate electrode, a fifth source electrode, and a fifth drain electrode;

wherein the fourth gate electrode and the fifth gate electrode are connected to the third source electrode, the fourth source electrode and the fifth source electrode are connected to the second electrode plate of the capacitor and the first output terminal, the fourth drain electrode is connected to the low level input terminal, and the fifth drain is connected to the third gate electrode.

3. The row driving circuit according to claim 2, wherein the n-th stage array substrate row driving unit further comprises a low frequency clock signal first input terminal and a low frequency clock signal second input terminal;

wherein the first pull-down controlling sub-unit further comprises a sixth thin film transistor and a seventh thin film transistor, the sixth thin film transistor comprises a sixth gate electrode, a sixth source electrode, and a sixth drain electrode, and the seventh thin film transistor comprises a seventh gate electrode, a seventh source electrode, and a seventh drain electrode;

wherein the sixth gate electrode, the six source electrode, and the seventh source electrode are connected to the low frequency clock signal first input terminal, the seventh gate electrode is connected to the low frequency clock signal second input terminal, and the sixth drain electrode and the seventh drain are connected to the fourth gate electrode.

4. The row driving circuit according to claim 3, wherein the n-th stage array substrate row driving unit further comprises a second pull-down controlling sub-unit;

wherein the second pull-down controlling sub-unit comprises an eighth thin film transistor, and the eighth thin film transistor comprises an eighth gate electrode, an eighth source electrode, and an eighth drain electrode;

wherein the eighth gate electrode is connected to the first drain electrode, the eighth drain electrode is connected to the low level input terminal;

wherein the second pull-down controlling sub-unit further comprises a ninth thin film transistor and a tenth thin film transistor, the ninth thin film transistor comprises a ninth gate electrode, a ninth source electrode, and a ninth drain electrode, and the tenth thin film transistor comprises a tenth gate electrode, a tenth source electrode, and a tenth drain electrode;

wherein the ninth gate electrode and the tenth gate electrode are connected to the eighth source electrode, the ninth source electrode and the tenth source electrode are connected to the fourth source electrode, the fifth source electrode, the second electrode plate of the capacitor, and the first output terminal, the ninth drain electrode is connected to the low level input terminal, and the tenth drain electrode is connected to the eighth gate electrode.

5. The row driving circuit according to claim 4, wherein the second pull-down controlling sub-unit further comprises an eleventh thin film transistor and twelfth thin film transistor, and the eleventh thin film transistor comprises an eleventh gate electrode, an eleventh source electrode, and an eleventh drain electrode, and the twelfth thin film transistor comprises a twelfth gate electrode, a twelfth source electrode, and a twelfth drain electrode;

wherein the eleventh gate electrode, the eleventh source electrode, and the twelfth source electrode are connected to the low frequency clock signal second input terminal, the twelfth gate electrode is connected to the low frequency clock signal first input terminal, and the eleventh drain electrode and the twelfth drain electrode are connected to the ninth gate electrode.

6. The row driving circuit according to claim 5, wherein the pull-down unit is a thirteenth thin film transistor, and the thirteenth thin film transistor comprises a thirteenth gate electrode, a thirteenth source electrode, and a thirteenth drain electrode;

wherein the thirteenth gate electrode is connected to the (n+2)-th stage signal input terminal, the thirteenth drain electrode is connected to the low level input terminal, and the thirteenth source electrode is connected to the second gate electrode.

7. A row driving circuit for an array substrate, comprising array substrate row driving units with multi-stage connections, wherein an n-th stage array substrate row driving unit in the row driving circuit for the array substrate comprises:

an (n−3)-th stage signal input terminal, an (n−2)-th stage signal input terminal, an (n+2)-th stage signal input terminal, a first output terminal, a second output terminal, a low level input terminal, and a high frequency clock signal input terminal, wherein n is a positive integer greater than 3;

wherein the (n−3)-th stage signal input terminal is connected to the second output terminal of an (n−3)-th stage array substrate row driving unit, ad the (n−2)-th stage signal input terminal is connected to the first output terminal of an (n−2)-th stage array substrate row driving unit, the (n+2)-th signal input terminal is connected to the first output terminal of an (n+2) stage array substrate row driving unit, the second output terminal is connected to an (n−3)-th stage signal input terminal of an (n+3)-th stage array substrate row driving unit, and the first output terminal is connected to an (n−2)-th stage signal input terminal of an (n+2)-th stage array substrate row driving unit and an (n+2)-th stage signal input terminal of an (n−2)-th stage array substrate row driving unit for providing a scanning signal to a n-th stage horizontal scanning line of a display area;

wherein the n-th stage array substrate row driving unit further comprises:

a pull-up controlling unit including a first thin film transistor, wherein the first thin film transistor is connected to the (n−3)-th stage signal input terminal, the (n−2)-th stage signal input terminal, and the second output terminal, and a peak voltage of the (n−3)-th stage signal input terminal is twice a peak voltage of the (n−2)-th stage signal input terminal for pulling up an electric potential of the second output terminal;

wherein a pull-up unit is connected to the high frequency clock signal input terminal and the first output terminal, and the pull-up controlling unit and pull-up unit are connected to the second output terminal for charging a signal of the first output terminal, and thus the second output terminal has a higher electric potential;

wherein the low level input terminal, the pull-up controlling unit and the pull-up unit are connected to a pull-down controlling unit for keeping a low electric potential of the second output terminal and the first output terminal when the signal of the first output terminal is non-chargeable;

wherein the (n+2)-th stage signal input terminal, the low level input terminal, and the pull-down controlling unit are connected to the pull-down unit, and the pull-down unit, the pull-up unit, and the pull-up controlling unit are connected to the second output terminal for pulling down an electric potential of the second output terminal.

8. The row driving circuit according to claim 7, wherein the first thin film transistor comprises a first gate electrode, a first source electrode, and a first drain electrode;

wherein the first gate electrode is connected to the (n−3)-th stage signal input terminal, the first source electrode is connected to the (n−2)-th stage signal input terminal, the first drain electrode is connected to the pull-down controlling unit, and the first drain electrode, the pull-down unit, and the pull-up unit are connected to the second output terminal.

9. The row driving circuit according to claim 8, wherein the pull-down controlling unit comprises a first pull-down controlling sub-unit;

wherein the first pull-down controlling sub-unit comprises a third thin film transistor, and the third thin film transistor comprises a third gate electrode, a third source electrode, and a third drain electrode;

wherein the third gate electrode is connected to the first drain electrode, and the third drain is connected to the low level input terminal;

wherein the first pull-down controlling sub-unit further comprises a fourth thin film transistor and a fifth thin film transistor, and the fourth thin film transistor comprises a fourth gate electrode, a fourth source electrode, and a fourth drain electrode, and the fifth thin film transistor comprises a fifth gate electrode, a fifth source electrode, and a fifth drain electrode;

wherein the fourth gate electrode and the fifth gate electrode are connected to the third source electrode, the fourth source electrode and the fifth source electrode are connected to the second electrode plate of the capacitor and the first output terminal, the fourth drain electrode is connected to the low level input terminal, and the fifth drain is connected to the third gate electrode.

10. The row driving circuit according to claim 9, wherein the n-th stage array substrate row driving unit further comprises a low frequency clock signal first input terminal and a low frequency clock signal second input terminal;

wherein the first pull-down controlling sub-unit further comprises a sixth thin film transistor and a seventh thin film transistor, the sixth thin film transistor comprises a sixth gate electrode, a sixth source electrode, and a sixth drain electrode, and the seventh thin film transistor comprises a seventh gate electrode, a seventh source electrode, and a seventh drain electrode;

wherein the sixth gate electrode, the six source electrode, and the seventh source electrode are connected to the low frequency clock signal first input terminal, the seventh gate electrode is connected to the low frequency clock signal second input terminal, and the sixth drain electrode and the seventh drain are connected to the fourth gate electrode.

11. The row driving circuit according to claim 10, wherein the n-th stage array substrate row driving unit further comprises a second pull-down controlling sub-unit;

wherein the second pull-down controlling sub-unit comprises an eighth thin film transistor, the eighth thin film transistor comprises an eighth gate electrode, an eighth source electrode, and an eighth drain electrode;

wherein the eighth gate electrode is connected to the first drain electrode, and the eighth drain electrode is connected to the low level input terminal;

wherein the second pull-down controlling sub-unit further comprises a ninth thin film transistor and a tenth thin film transistor, the ninth thin film transistor comprises a ninth gate electrode, a ninth source electrode, and a ninth drain electrode, and the tenth thin film transistor comprises a tenth gate electrode, a tenth source electrode, and a tenth drain electrode;

wherein the ninth gate electrode and the tenth gate electrode are connected to the eighth source electrode, the ninth source electrode and the tenth source electrode are connected to the fourth source electrode, the fifth source electrode, the second electrode plate of the capacitor and the first output terminal, the ninth drain electrode is connected to the low level input terminal, and the tenth drain electrode is connected to the eighth gate electrode.

12. The row driving circuit according to claim 11, wherein the second pull-down controlling sub-unit further comprises an eleventh thin film transistor and twelfth thin film transistor, the eleventh thin film transistor comprises an eleventh gate electrode, an eleventh source electrode, and an eleventh drain electrode, and the twelfth thin film transistor comprises a twelfth gate electrode, a twelfth source electrode, and a twelfth drain electrode;

wherein the eleventh gate electrode, the eleventh source electrode, and the twelfth source electrode are connected to the low frequency clock signal second input terminal, the twelfth gate electrode is connected to the low frequency clock signal first input terminal, and the eleventh drain electrode and the twelfth drain electrode are connected to the ninth gate electrode.

13. The row driving circuit according to claim 12, wherein the pull-down unit is a thirteenth thin film transistor, and the thirteenth thin film transistor comprises a thirteenth gate electrode, a thirteenth source electrode, and a thirteenth drain electrode;

wherein the thirteenth gate electrode is connected to the (n+2)-th stage signal input terminal, the thirteenth drain electrode is connected to the low level input terminal, and the thirteenth source electrode is connected to the second gate electrode.

14. The row driving circuit according to claim 7, wherein the pull-up unit includes a capacitor and a second thin film transistor, the second thin film transistor comprises a second gate electrode, a second source electrode and a second drain electrode, and the capacitor comprises a first electrode plate and a second electrode plate;

wherein the second gate electrode is connected to the pull-up controlling unit and the first electrode plate of the capacitor through the second output terminal, the second source electrode is connected to the high frequency clock signal input terminal, and the second drain electrode is connected to the first output terminal.

15. A liquid crystal display device comprising a row driving circuit for the array substrate and a display area connected to the array substrate row driving circuit, wherein the array substrate row driving circuit comprises array substrate row driving units with multi-stage connections, and an n-th stage array substrate row driving unit in the row driving circuit for the array substrate comprises:

an (n−3)-th stage signal input terminal, an (n−2)-th stage signal input terminal, an (n+2)-th stage signal input terminal, a first output terminal, a second output terminal, a low level input terminal, and a high frequency clock signal input terminal, wherein n is a positive integer greater than 3;

wherein the (n−3)-th stage signal input terminal is connected to the second output terminal of an (n−3)-th stage array substrate row driving unit, the (n−2)-th stage signal input terminal is connected to the first output terminal of an (n−2)-th stage array substrate row driving unit, the (n+2)-th signal input terminal is connected to the first output terminal of an (n+2)-th stage array substrate row driving unit, the second output terminal is connected to an (n−3)-th stage signal input terminal of an (n+3)-th stage array substrate row driving unit, and the first output terminal is connected to an (n−2)-th stage signal input terminal of an (n+2)-th stage array substrate row driving unit and an (n+2)-th stage signal input terminal of an (n−2)-th stage array substrate row driving unit for providing a scanning signal to an n-th stage horizontal scanning line of a display area;

wherein the n-th stage array substrate row driving unit further comprises:

a pull-up controlling unit including a first thin film transistor, wherein the first thin film transistor is connected to the (n−3)-th stage signal input terminal, the (n−2)-th stage signal input terminal, and the second output terminal, and a peak voltage of the (n−3)-th stage signal input terminal is twice a peak voltage of the (n−2)-th stage signal input terminal for pulling up an electric potential of the second output terminal;

wherein the pull-up unit is connected to the high frequency clock signal input terminal and the first output terminal, and the pull-up controlling unit and pull-up unit are connected to the second output terminal for charging a signal of the first output terminal, and thus the second output terminal has a higher electric potential;

wherein the low level input terminal, the pull-up controlling unit, and the pull-up unit are connected to a pull-down controlling unit for keeping a low electric potential of the second output terminal and the first output terminal when the signal of the first output terminal is non-chargeable;

wherein the (n+2)-th stage signal input terminal, the low level input terminal, and the pull-down controlling unit are connected to a pull-down unit, and the pull-down unit, the pull-up unit, and the pull-up controlling unit are connected to the second output terminal for pulling down the electric potential of the second output terminal.

16. The liquid crystal display device according to claim 15, wherein the display area comprises horizontal scanning lines, two ends of each scanning line are connected the array substrate row driving units respectively, and the horizontal scanning lines are connected to the first output terminal of the array substrate row driving units.

* * * * *